US010008358B2

(12) United States Patent
Jeong et al.

(10) Patent No.: US 10,008,358 B2
(45) Date of Patent: Jun. 26, 2018

(54) X-RAY SOURCE AND APPARATUS INCLUDING THE SAME

(71) Applicant: ELECTRONICS AND TELECOMMUNICATIONS RESEARCH INSTITUTE, Daejeon (KR)

(72) Inventors: Jin-Woo Jeong, Daejeon (KR); Yoon-Ho Song, Daejeon (KR)

(73) Assignee: ELECTRONICS AND TELECOMMUNICATIONS RESEARCH INSTITUTE, Daejeon (KR)

( * ) Notice: Subject to any disclaimer, the term of this patent is extended or adjusted under 35 U.S.C. 154(b) by 194 days.

(21) Appl. No.: 15/229,063

(22) Filed: Aug. 4, 2016

(65) Prior Publication Data

US 2017/0048955 A1 Feb. 16, 2017

(30) Foreign Application Priority Data

Aug. 11, 2015 (KR) ..... 10-2015-0112952
Apr. 4, 2016 (KR) ..... 10-2016-0041137

(51) Int. Cl.
*H01J 35/06* (2006.01)
*H01J 35/16* (2006.01)
*G21K 1/02* (2006.01)

(52) U.S. Cl.
CPC ..... *H01J 35/06* (2013.01); *G21K 1/02* (2013.01); *H01J 35/065* (2013.01); *H01J 35/16* (2013.01); *H01J 2201/30469* (2013.01); *H01J 2235/068* (2013.01); *H01J 2235/166* (2013.01)

(58) Field of Classification Search
CPC ..... H01J 35/065; H01J 2201/30469; H01J 2235/16; H01J 2235/166; H01J 2235/165
USPC ..... 378/16
See application file for complete search history.

(56) References Cited

U.S. PATENT DOCUMENTS 5,796,805 A * 8/1998 Armentrout ..... H01J 35/14 378/119
9,048,059 B2 6/2015 Jeong et al.
9,099,280 B2 8/2015 Jeong et al.
2007/0247049 A1* 10/2007 Li ..... B82Y 10/00 313/311
2008/0238285 A1* 10/2008 Hong ..... H01J 9/025 313/309
2012/0250827 A1* 10/2012 Jeong ..... H01J 35/065 378/122

FOREIGN PATENT DOCUMENTS

KR 10-2013-0084257 A 7/2013
KR 10-2015-0090502 A 8/2015

OTHER PUBLICATIONS

"ETRI Creative Research Sections Project", Jan. 2016, pp. 190-206.

* cited by examiner

*Primary Examiner* — Kenneth J Malkowski

(57) ABSTRACT

Disclosed is an X-ray source, including: a cathode including a shielding channel through which an X-ray passes; emitters formed on an upper surface of the cathode, and arranged around the shielding channel; an anode positioned so as to face the cathode, and including an anode target in which an E-beam is focused; and a gate electrode positioned between the cathode and the anode, and including gate holes at positions corresponding to those of the emitters.

17 Claims, 9 Drawing Sheets

X-RAY SOURCE AND APPARATUS INCLUDING THE SAME

CROSS-REFERENCE TO RELATED APPLICATION

The present application claims priority to Korean Patent Application Numbers 10-2015-0112952 filed on Aug. 11, 2015 and 10-2016-0041137 filed on Apr. 4, 2016, in the Korean Intellectual Property Office, the entire disclosure of which is incorporated by reference herein.

BACKGROUND

1. Field

The present disclosure relates to an X-ray source, and more particularly, to an X-ray tube, of which a radiation angle is adjustable, and an apparatus including the same.

2. Description of the Related Art

An X-ray tube includes a cathode, emitters formed on the cathode, and an anode. Electrons emitted from the emitter are accelerated by a voltage difference between the anode and the cathode and move toward the anode, and when an E-beam collides with an anode target, kinetic energy of the electrons is converted into an X-ray and the X-ray is emitted. That is, the X-ray is emitted. In the X-ray tube in the related art, an X-ray is radiated in all directions, so that a method of adjusting a radiation angle of the X-ray is required.

SUMMARY

The present disclosure has been made in an effort to solve the above-described problems associated with the prior art, and provides an X-ray source which is capable of adjusting a radiation angle.

The present disclosure has also been made in an effort to solve the above-described problems associated with the prior art, and provides an X-ray device, in which a plurality of X-ray sources is arranged in an array form.

An exemplary embodiment of the present disclosure provides an X-ray source, including: a cathode including a shielding channel through which an X-ray passes; emitters formed on an upper surface of the cathode, and arranged around the shielding channel; an anode positioned so as to face the cathode, and including an anode target in which an E-beam is focused; and a gate electrode positioned between the cathode and the anode, and including gate holes at positions corresponding to those of the emitters.

An exemplary embodiment of the present disclosure provides an X-ray device, including: a plurality of X-ray sources, each of which includes a cathode including a shielding channel, through which an X-ray passes, emitters formed on an upper surface of the cathode and arranged around the shielding channel, an anode positioned so as to face the cathode and including an anode target in which an E-beam is focused, and a gate electrode positioned between the cathode and the anode, and including gate holes at positions corresponding to those of the emitters, wherein the plurality of X-ray sources is arranged in an array form.

According to the exemplary embodiment of the present disclosure, it is possible to arbitrarily adjust a radiation angle of an X-ray by using the shielding channel of the cathode. Accordingly, it is possible to generate a subparallel X-ray by decreasing a radiation angle of the X-ray. Further, it is possible to generate a plane X-ray or an X-ray capable of performing tomography by increasing a radiation angle of the X-ray.

Further, it is possible to provide a multi-X-ray source capable of performing a queue control by arranging the plurality of X-ray sources, of which a radiation angle is controllable by the shielding channel, in an array form.

BRIEF DESCRIPTION OF THE DRAWINGS

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey the scope of the example embodiments to those skilled in the art.

In the drawing figures, dimensions may be exaggerated for clarity of illustration. It will be understood that when an element is referred to as being "between" two elements, it can be the only element between the two elements, or one or more intervening elements may also be present. Like reference numerals refer to like elements throughout.

FIG. 3A is a layout, and FIG. 3B is a cross-sectional view.

FIG. 5A is a perspective view illustrating an internal structure of the X-ray source, and FIG. 5B represents an X-ray source array.

DETAILED DESCRIPTION OF THE INVENTION

Hereinafter, the exemplary embodiments of the present disclosure will be described with reference to the accompanying drawings in detail so that those skilled in the art may easily carry out the present disclosure.

Figure 1A:
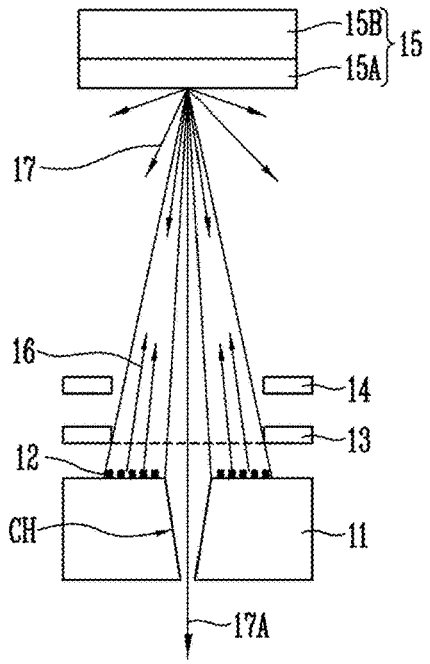
FIGS. 1A and 1B are cross-sectional views illustrating a structure of an X-ray source according to an exemplary embodiment of the present disclosure.
Figure 1B:
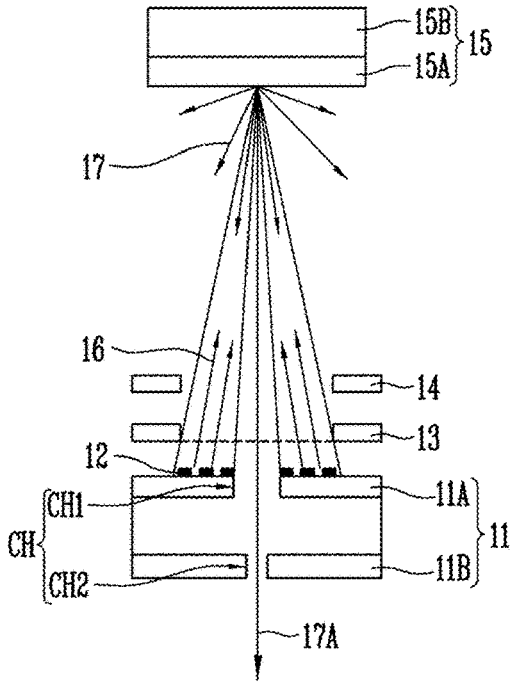

FIGS. 1A and 1B are cross-sectional views illustrating a structure of an X-ray source according to an exemplary embodiment of the present disclosure.

Referring to FIGS. 1A and 1B, the X-ray source according to the exemplary embodiment of the present disclosure includes a cathode 11, emitters 12, a gate electrode 13, a focusing electrode 14, and an anode 15.

The cathode 11 includes a shielding channel CH through which an X-ray passes. The shielding channel CH may be an opening which passes through the cathode 11 in a thickness direction of the cathode, and a length of the shielding channel CH is determined according to a thickness of the cathode 11. A material of the cathode 11 may be determined in consideration of energy of an X-ray, a structure of an X-ray source, and a degree of X-ray shielding.

Further, a form of the shielding channel CH may be determined in consideration of a radiation angle of an X-ray, and a diameter of an X-ray which passes through the shielding channel CH and reaches a detector. For example, a cross-section of the shielding channel CH may have various forms, such as a circle, an ellipse, a quadrangle, and a polygon, and widths of an inlet and an outlet of the shielding channel CH may be the same or different from each other. Further, the cathode 11 may include one shielding channel CH or include a plurality of shielding channels CJ.

The anode 15 may be positioned so as to face the cathode 11, and may be positioned on the cathode 11 while being spaced apart from the cathode 11 by a predetermined distance. The anode 15 may include an electrode 15B and an anode target 15A attached to the electrode 15B. The anode target 15A includes a material, for example, tungsten, molybdenum, and copper, with which an E-beam collides to generate an X-ray.

The emitter 12 is formed on the cathode 11, and is arranged around the shielding channel CH. For example, the emitter 12 may be a thermoelectric source or a field-emission electron source. Further, the emitter 12 may be arranged in a dot array form.

The gate electrode 13 may be positioned on the cathode 11, and may include gate holes at positions corresponding to those of the emitters 12. When a plurality of emitters 12 is formed on the cathode 11, the gate electrode 13 may include a plurality of gate holes. For example, the gate electrode 13 may have a mesh form. Further, the gate electrode 13 may include an opening for allowing an X-ray to pass through.

The focusing electrode 14 may be positioned between the gate electrode 14 and the anode 15, and may include an opening for allowing an X-ray to pass through, similar to the gate electrode 13. The focusing electrode 14 serves to adjust a diameter of the E-beam reaching the anode 15. Accordingly, it is possible to adjust a radiation angle of the emitted X-ray by adjusting a diameter of the E-beam reaching the anode 15 by the focusing electrode 14.

For reference, although not illustrated in the present drawing, the X-ray source may have a tube structure, and an insulating spacer for maintaining a vacuum atmosphere may be positioned between the cathode 11 and the anode 15. Further, the gate electrode 13 or the focusing electrode 14 may be omitted.

According to the aforementioned structure, the electrons emitted from the emitter 12 are accelerated toward the anode 15 and passes through the openings of the gate electrode 13 and the focusing electrode 14. Further, an E-beam 16 collides with the anode target 15A to generate an X-ray 17. The generated X-ray 17 may be emitted in all directions, and a part of the generated X-ray passes through the shielding channel CH of the cathode 11. That is, the shielding channel CH serves as a filter to allow only the X-ray 17, which is radiated at a predetermined angle, to pass through, and thus it is possible to generate a subparallel X-ray 17A. Accordingly, an intensity and a radiation form of the X-ray 17, which passes through the shielding channel CH, may be adjusted by controlling a length, a width, and the like of the shielding channel CH. That is, it is possible to adjust a radiation angle of the X-ray 17.

Referring to FIG. 1A, the cathode 11 may include one shielding channel CH. Referring to FIG. 1B, the cathode 11 may include a plurality of shielding channels CH1 and CH2 which is positioned above and below. FIG. 1B illustrates a case where the cathode 11 includes a first plate 11A including a first shielding channel CH1 and a second plate 11B including the second shielding channel CH2. In this case, the emitted X-ray sequentially passes through the first shielding channel CH1 and the second shielding channel CH2. Further, the first shielding channel CH1 and the second shielding channel CH2 may be positioned while overlapping above and below, and may have the same form or different forms. For example, the second shielding channel CH2 may have a smaller width than that of the first shielding channel CH1. Accordingly, it is possible to more minutely adjust the radiation angle of the X-ray 17*b* adjusting positions, forms, sizes, and the like of the first and second shielding channels CH1 and CH2.

Figure 2A:
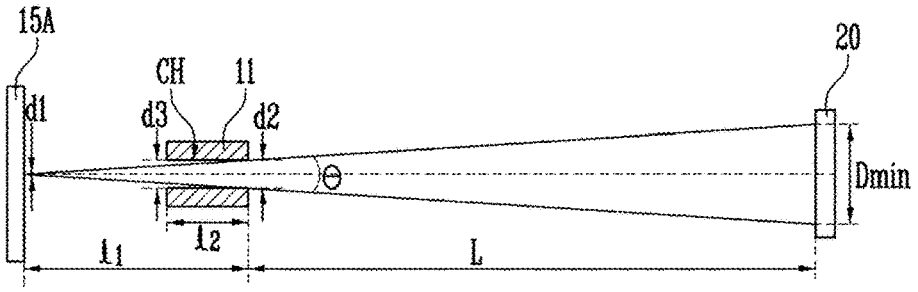
FIGS. 2A to 2C are cross-sectional views for describing a principle of adjusting a radiation angle of the X-ray source according to the exemplary embodiment of the present disclosure.
Figure 2B:
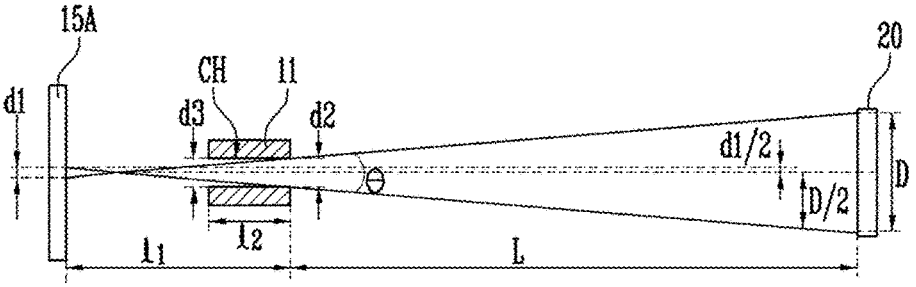
Figure 2C:
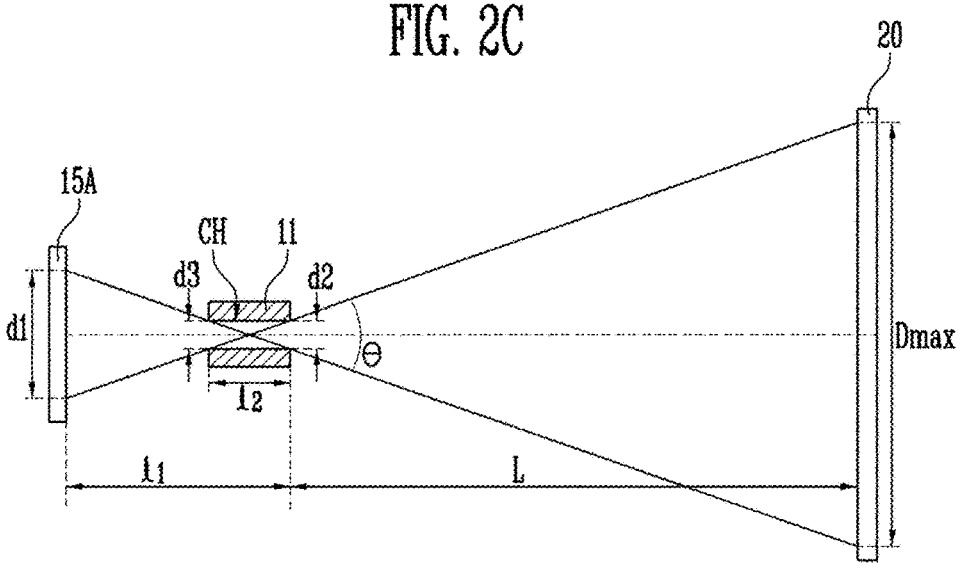

FIGS. 2A to 2C are cross-sectional views for describing a principle of adjusting a radiation angle of the X-ray source according to the exemplary embodiment of the present disclosure, and are illustrated based on the anode target 15A, the cathode 11, the shielding channel CH, and a detector 20.

In each drawing, $d_1$ represents a diameter of an E-beam focused in the anode target 15A, that is, a diameter of a focal spot. $d_2$ represents a diameter of the outlet of the shielding channel CH, and $d_3$ represents a diameter of the inlet of the shielding channel CH. l1 represents a distance from a surface of the anode target 15A to the outlet of the shielding channel CH. l2 represents a distance of the shielding channel L represents a distance from the outlet of the shielding channel CH to a surface of the detector 20. θ represents a radiation angle of the X-ray emitted from the anode target 15A. Further, D represents a diameter D of the X-ray which passes through the shielding channel CH and reaches the detector 20.

Hereinafter, a determination of the radiation angle θ of the X-ray emitted from the anode target 15A and the diameter D of the X-ray which passes through the shielding channel CH and reaches the detector 20 according to the diameter $d_1$ of the focal spot when a diameter $d_2$ of the outlet of the shielding channel CH is the same as or smaller than a diameter $d_3$ of the inlet ($d_3 \geq d_2$) will be described with reference to the Equations.

Referring to FIG. 2A and Equation 1, it can be seen that when the diameter $d_1$ of the focal spot has a small value which is close to 0, the radiation angle θ of the emitted X-ray and the diameter D of the X-ray reaching the detector 20 are determined according to the diameter $d_2$ of the outlet of the shielding channel CH.

$$d_1 \approx 0,\ d_3 \geq d_2 \qquad \text{[Equation 1]}$$

$$D_{min} = d_2\left(1 + \frac{L}{l1}\right)$$

$$\theta_{min} = 2\tan^{-1}\left(\frac{D_{min} - d_2}{2L}\right)$$

Equation 2 represents a calculation of a maximum value $d_{1max}$ of the diameter of the meaningful focal spot. As described above, it is possible to adjust the diameter $d_1$ of the focal spot by using the focusing electrode. Further, when the diameter $d_1$ of the focal spot is increased, the radiation angle θ of the emitted X-ray is increased. However, according to the exemplary embodiment of the present disclosure, since only a part of the emitted X-ray is capable of passing through the shielding channel CH, the radiation angle θ of the X-ray, which is capable of passing through the shielding channel CH is limited. Accordingly, the maximum diameter $d_{1max}$ of the focal spot is determined according to the diameter $d_3$ of the inlet and the diameter $d_2$ of the outlet of the shielding channel CH, and may be calculated by using Equation 2.

$$d_{1max} = \frac{l_1}{l_2}(d_2 + d_3) - d_2 \quad \text{[Equation 2]}$$

Referring to FIG. 2B and Equation 3, it can be seen that when the diameter $d_1$ of the focal spot has a smaller value than that of $d_{1max}$, the radiation angle θ of the emitted X-ray and the diameter D of the X-ray reaching the detector 20 are determined according to the diameter $d_2$ of the outlet of the shielding channel CH.

$$d_1 < d_{1max},\ d_3 \geq d_2 \quad \text{[Equation 3]}$$

$$D = \frac{d_1 + d_2}{l_1}L + d_2$$

$$\theta = 2\tan^{-1}\left(\frac{D - d_2}{2L}\right)$$

Referring to FIG. 2C and Equation 4, it can be seen that when the diameter $d_1$ of the focal spot is $d_{1max}$, the radiation angle θ of the emitted X-ray and the diameter D of the X-ray reaching the detector 20 are determined according to the diameter $d_1$ of the inlet and the diameter $d_2$ of the outlet of the shielding channel CH.

$$d_1 = d_{1max},\ d_3 \geq d_2 \quad \text{[Equation 4]}$$

$$D_{max} = \frac{d_2 + d_3}{l_2}L + d_2$$

$$\theta_{max} = 2\tan^{-1}\left(\frac{d_2 - d_3}{2l_2}\right)$$

Accordingly, it is possible to adjust the radiation angle of the X-ray according to the structure of the X-ray source, particularly, the diameter $d_3$ of the inlet and the diameter $d_2$ of the outlet of the shielding channel CH. For example, it is possible to manufacture the X-ray source having a narrow radiation angle so that the X-ray is emitted with a narrow angle, and it is possible to manufacture a surface-emitting X-ray source by configuring the X-ray source in an array form. Further, it is possible to manufacture an X-ray source having a wide radiation angle and use the manufactured X-ray source for a Computer Tomography (CT), a tomography, and the like.

Figure 3A:
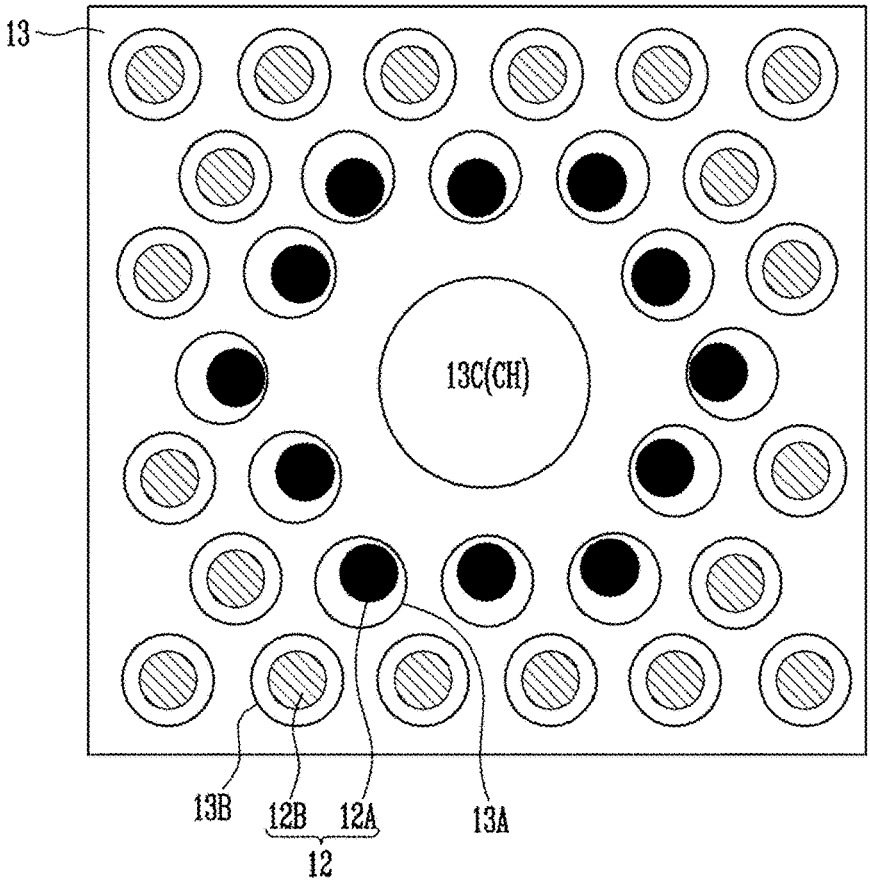
FIGS. 3A and 3B are diagrams for describing an emitter arrangement scheme of the X-ray source according to the exemplary embodiment of the present disclosure.
Figure 3B:
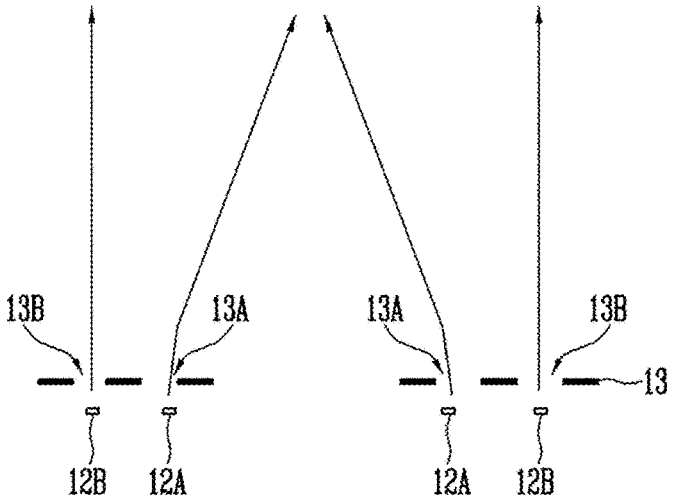

FIGS. 3A and 3B are diagrams for describing an emitter arrangement scheme of the X-ray source according to the exemplary embodiment of the present disclosure, and FIG. 3A is a layout, and FIG. 3B is a cross-sectional view.

Referring to FIG. 3A, the emitter 12 is arranged around the shielding channel CH of the cathode, and includes a first emitter 12A which is relatively adjacent to the shielding channel CH, and a second emitter 12B which is relatively spaced apart from the shielding channel CH. The gate electrode 13 includes a first gate hole 13A which is formed at a position corresponding to that of the first emitter 12A, a second gate hole 13B which is formed at a position corresponding to that of the second emitter 12B, and an opening 13C for allowing an X-ray to pass through. Here, the opening 13C may be formed at the position corresponding to that of the shielding channel CH, and may have a similar form and size to those of the shielding channel CH.

However, since the emitter 12 is not present at the position corresponding to that of the shielding channel CH, a center region of the focused E-beam may have a relatively low density. Accordingly, the arrangement of the emitter 12 may be adjusted so that a center and an outer side of the E-beam have a uniform density. For example, the first emitter 12A is positioned within the first gate hole 13A, but a center axis of the first emitter 12A and a center axis of the first gate hole 13A are offset, so that the first emitter 12A is arranged to be adjacent to the shielding channel CH. Further, the second emitter 12B is arranged so that a center axis of the second emitter 12A corresponds to a center axis of the second gate hole 13B. Accordingly, the E-beam may have a uniform density by increasing a density of the center of the E-beam. In this case, it is possible to differently adjust a degree of the offset of the axis of the emitter 12 and the axis of the gate hole 13 according to a distance between the shielding channel CH and the emitter 12. For example, when the distance is small, the offset value is increased, and the distance is large, the offset value is decreased. Accordingly, it is possible to minutely adjust a degree of deflection of the E-beam. However, it is necessary to adjust the position of the emitter 12 so that a leakage current is not caused.

Figure 4A:
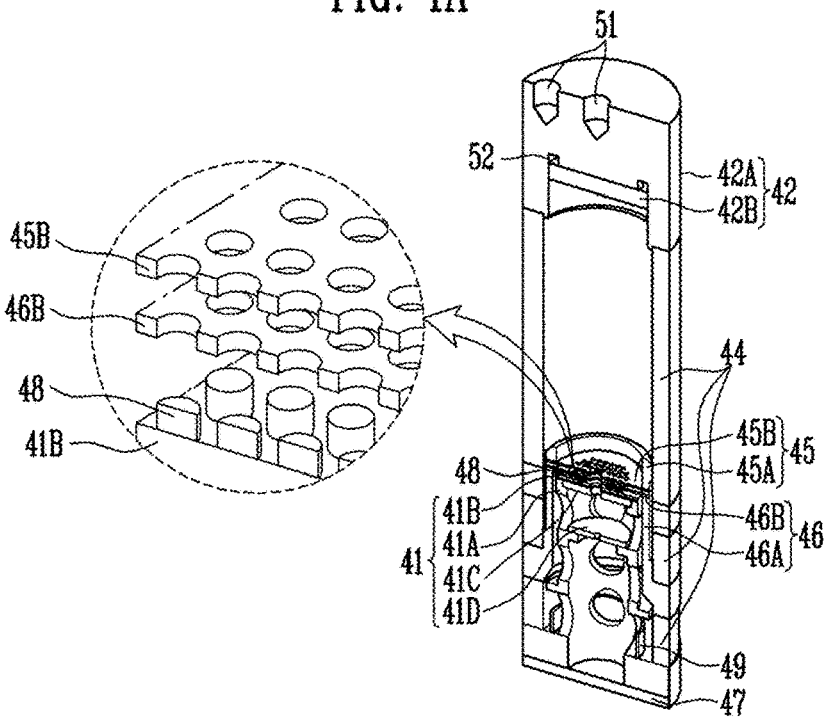
FIGS. 4A and 4B are perspective views illustrating a structure of an X-ray source according to an exemplary embodiment of the present disclosure, and are design diagrams for manufacturing an X-ray tube.
Figure 4B:
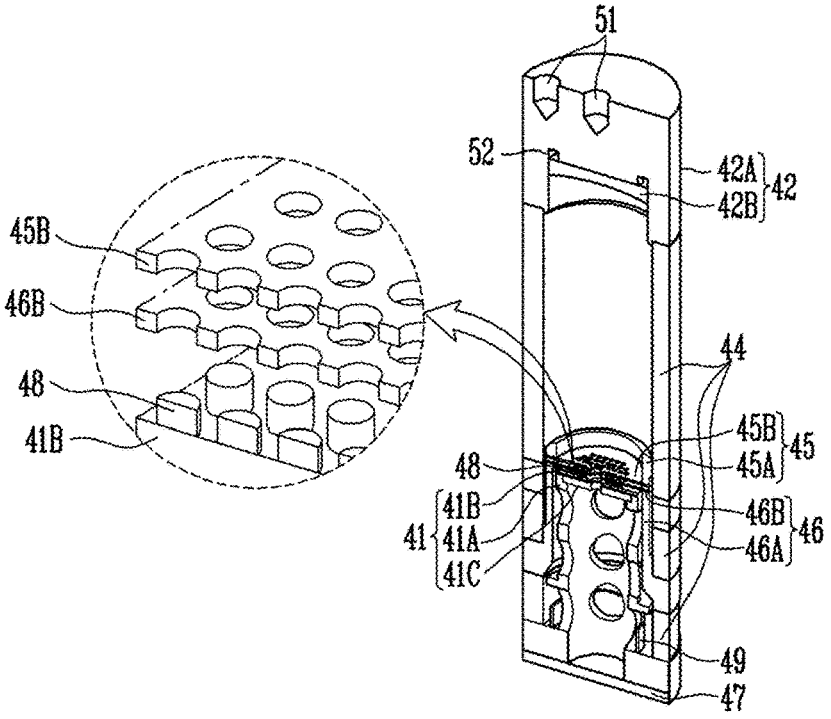

FIGS. 4A and 4B are perspective views illustrating a structure of an X-ray source according to an exemplary embodiment of the present disclosure, and are design diagrams for manufacturing an X-ray tube.

Referring to FIG. 4A, the X-ray tube may include a cathode 41, an anode 42, insulating spacers 44, a focusing electrode 45, a gate electrode 46, an X-ray window 47, emitters 48, a getter 49, screw taps 51, and a filler overflow trench 52, or may include some of them.

The cathode 41 may include a cathode electrode 41A, a cathode sheet 41B, a first shielding plate 41C, and a second shielding plate 41D. The first and second shielding plates 41C and 41D include a first shielding channel and a second shielding channel, respectively, and the first and second shielding channels may have various forms and sizes which are described before with reference to FIGS. 1A to 3A. As described above, when the cathode 41 includes the plurality of shielding plates 41C and 41D, it is necessary to carefully arrange the shielding plates so as to prevent the plurality of shielding plates 41C and 41D from being mislocated. The cathode sheet 41B may be attached onto an upper surface of the cathode electrode 41A, and a nano emitter 48 may be attached to the cathode sheet 41B.

The anode 42 may include an anode electrode 42A and an anode target 42B. The anode target 42B may be attached onto a lower surface of the anode electrode 42A. The cathode 41 and the anode 42 may be positioned while facing each other, and the anode 42 may be positioned on the cathode 41.

The gate electrode 46 may be positioned between the cathode 41 and the anode 42, and may include a gate electrode 46A and a gate mesh 46B. The gate mesh 46B may include gate holes which are formed at a position corresponding to that of the array of the emitters 48. The focusing electrode 45 may be positioned between the anode 42 and the gate electrode 46, and may include a focusing electrode 45A and a focusing mesh 45B. The focusing mesh 45B may include holes which are formed at a position corresponding to that of the array of the emitter 48. The gate mesh 46B and the focusing mesh 45B may be manufactured so as to include holes which one to one correspond to the array of the emitter 48, and may independently apply a voltage. Further, the gate mesh 46B and the focusing mesh 45B may include openings corresponding to the first and second shielding channels of the first and second shielding plates 41C and 41D.

The screw tap 51 may be formed on an external surface of the anode 42, and the filler overflow trench 52 may be formed between the anode target 42B and the anode electrode 42A. The filler overflow trench 52 is for the purpose of preventing a braising filler made of a metal from overflowing and a contamination from being generated during a process of bonding the anode target 42B to the anode electrode 42A during a vacuum braising process.

The X-ray tube may be manufactured in a vacuum sealed form. For example, the X-ray tube is manufactured by inserting the braising filter into spaces between the cathode electrodes 41, 42, 45, and 46 and the insulating spacer 44, and then sealing the spaces under a high temperature vacuum condition. In this case, it is possible to insert the non-volatile getter 49 for securing a degree of vacuum. The getter 49 may be mounted at a position, for example, a lower side of the cathode 41, at which the getter 49 avoids an interference with another electrode.

In order to maintain vacuum within the X-ray tube, it is possible to install the X-ray window 47 at one end of the X-ray tube. The X-ray window 47 may be formed of a material, which allows the X-ray to pass through, and a material, such as beryllium (Be), which minimizes the absorption of the X-ray, may be selected as the material of the X-ray window 47. Otherwise, a metal having a filter function, and a material, such as a metal oxide, may be selected as the material of the X-ray window 47.

The insulating spacer 44 may be positioned between the cathode 41 and the anode 42, and may have a tube form. The insulating spacer 44 is formed of a material which is capable of sealing by using a metal filler or an active filler, and includes, for example, an aluminum oxide ($Al_2O_3$), sapphire, and a silicon nitride.

Referring to FIG. 4B, in the X-ray tube according to the exemplary embodiment of the present disclosure, a surface of the anode target 42B may have a concave surface, and thus it is possible to increase an intensity of emitted X-ray.

A point, at which the E-beam collides with the anode target 42B, is the focal spot, and the X-ray is emitted from the focal spot in all directions. In this case, the intensity of X-ray, which is vertically emitted from a surface of the anode target 42B, is highest. On the other hand, the X-ray emitted in a side direction from the surface of the anode target 42B is partially absorbed into the material of the anode target 42B, the intensity of X-ray is relatively low. That is, when an area of the anode target 42B, which collides with the E-beam, is increased, an intensity of X-ray, which is incident into the shielding channel of the shielding plate 42C, is increased. Accordingly, according to the exemplary embodiment of the present disclosure, the surface of the anode target 42B is processed in a concave form so that the surface of the anode target 42B has a curvature based on a position corresponding to that of the shielding channel. Accordingly, it is possible to increase the intensity of emitted X-ray in a surrounding region of the anode target 42B, as well as the center of the anode target 42B.

For reference the present drawing illustrates a case where the cathode 41 includes one shielding plate 41C, but the cathode 41 may include a plurality of shielding plates 41C. Further, other structures are the same as those described with reference to FIG. 4A.

Figure 5A:
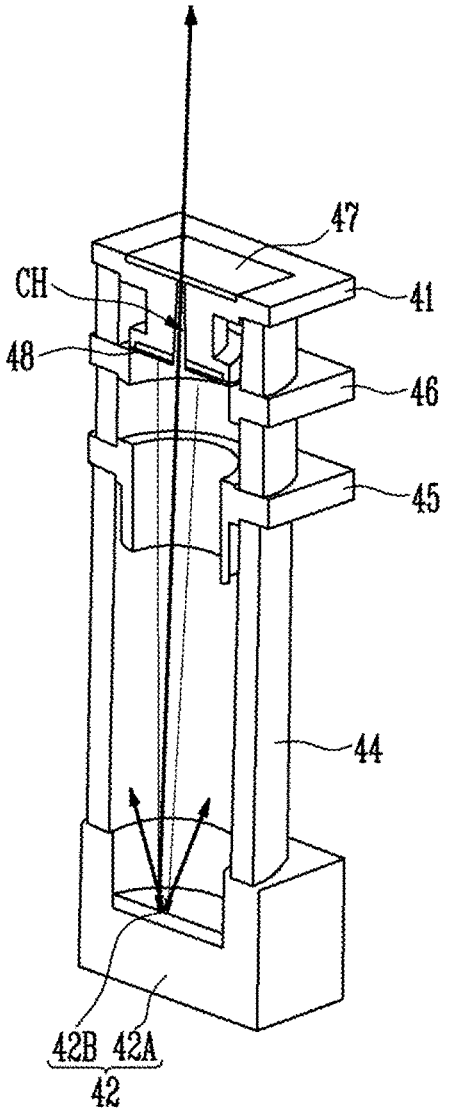
FIGS. 5A and 5B are perspective views illustrating an X-ray source according to an exemplary embodiment of the present disclosure.
Figure 5B:
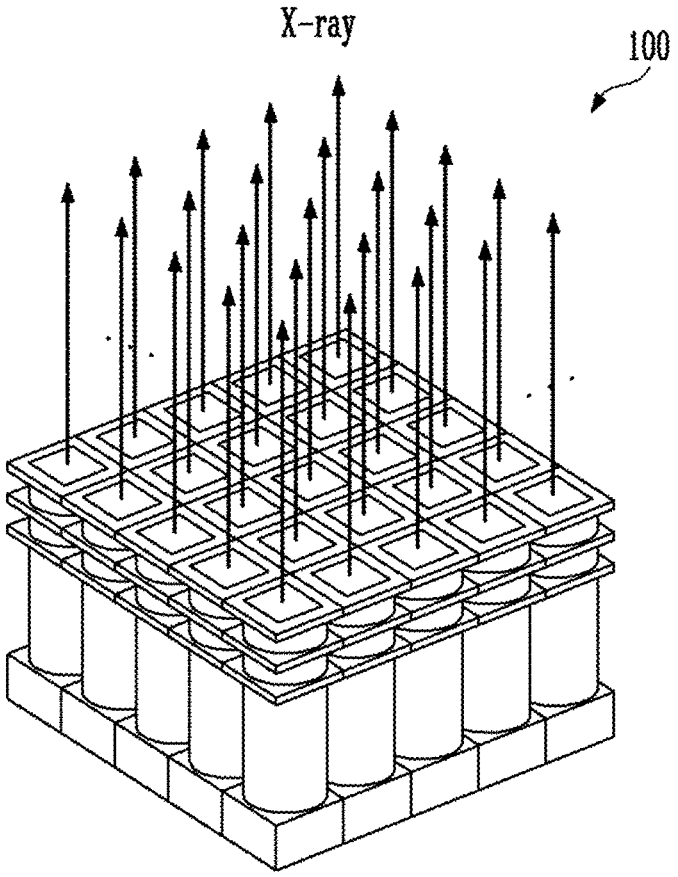

FIGS. 5A and 5B are perspective views illustrating an X-ray source according to an exemplary embodiment of the present disclosure, and FIG. 5A is a perspective view illustrating an internal structure of the X-ray source, and FIG. 5B represents an X-ray source array.

Referring to FIGS. 5A and 5B, in an X-ray device according to an exemplary embodiment of the present disclosure, one X-ray source is formed as a unit structure. That is, it is possible to manufacture the X-ray device by arranging the plurality of X-ray sources in an array form. Here, each X-ray source is separately sealed so as to independently have a vacuum state. Further, the X-ray source includes a cathode 41, an anode 42, an insulating spacer 44, a focusing electrode 45, a gate electrode 46, an X-ray window 47, and emitters 48, and the cathode 41 includes a shielding channel CH. The X-ray source may have the structure which is described with reference to FIGS. 1A to 4B.

According to the structure, an E-beam emitted from the emitter 48 passes through the gate electrode 46 and the focusing electrode 45 and collides with the anode target 42B, and the emitted X-ray is emitted through the shielding channel CH of the cathode 41. In this case, a diameter of the E-beam reaching the anode target 42B is adjusted by the focusing electrode 45, and a radiation angle of the X-ray is adjusted according to the diameter of the E-beam and a form of the shielding channel CH. Accordingly, it is possible to emit the X-ray having a specific radiation angle.

Further, the plurality of X-ray tubes is arranged in an array form, so that the X-ray, which is emitted from the X-ray tube, may also have an array form. Particularly, it is possible to spatially adjust an intensity of emitted X-ray by separately adjusting an intensity of E-beam emitted from each X-ray tube.

Figure 6:
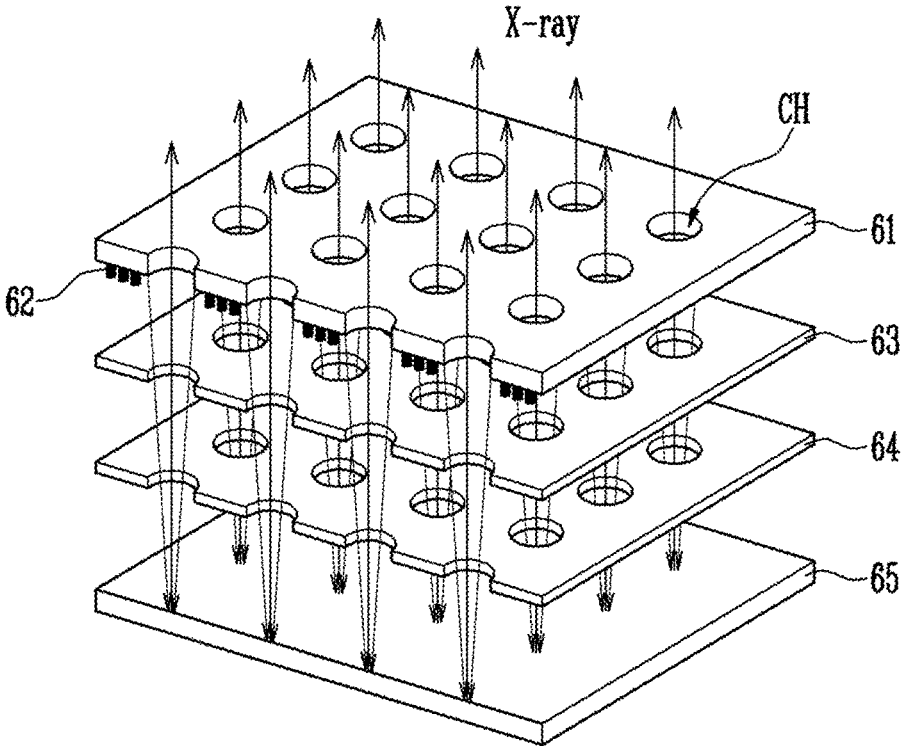
FIG. 6 is a perspective view illustrating a structure of a flat X-ray device according to an exemplary embodiment of the present disclosure.

FIG. 6 is a perspective view illustrating a structure of a flat X-ray device according to an exemplary embodiment of the present disclosure.

Referring to FIG. 6, an X-ray device according to an exemplary embodiment of the present disclosure may be manufactured by arranging a plurality of X-ray sources in an array form, and includes an array including the plurality of X-ray sources as a unit structure. Each array includes a cathode 61, emitters 62, a gate electrode 63, a focusing electrode 64, and an anode 65. Here, the cathode 61, the gate electrode 63, the focusing electrode 64, and the anode 65 are formed in a plate form.

The cathode 61 includes a plurality of shielding channels CH which pass through the plate in a thickness direction of the plate, and the emitters 62 are formed around the shielding channels CH. The gate electrode 63 and the focusing electrode 64 include openings at positions corresponding to those of the shielding channels.

According to the aforementioned structure, it is possible to implement the plurality of X-ray devices in one plate by arranging the shielding channels CH in one cathode 61 in the array form. In the X-ray device, which is described before with reference to FIGS. 5A and 5B, each X-ray source that is the unit structure is sealed. Contrary to this, in the X-ray device according to the present exemplary embodiment, the X-ray source is integrated to one plate, so that it is possible to simply manufacture the X-ray device by sealing the X-ray source in the array unit. Further, it is possible to adjust an intensity of emitted X-ray in a unit of an array by electrically separating the cathode 61 included in each X-ray source array.

FIGS. 7A to 7D are cross-sectional views illustrating an application example of an X-ray device according to an exemplary embodiment of the present disclosure.

Figure 7A:
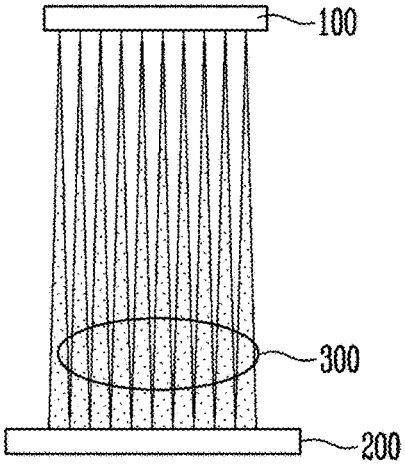
FIGS. 7A to 7D are cross-sectional views illustrating an application example of an X-ray device according to an exemplary embodiment of the present disclosure.

Referring to FIG. 7A, an X-ray source array 100 emits an X-ray with a narrow radiation angle. In this case, the subparallel X-ray emitted from the X-ray source array 100 reaches the detector 200 via a subject 300.

Figure 7B:
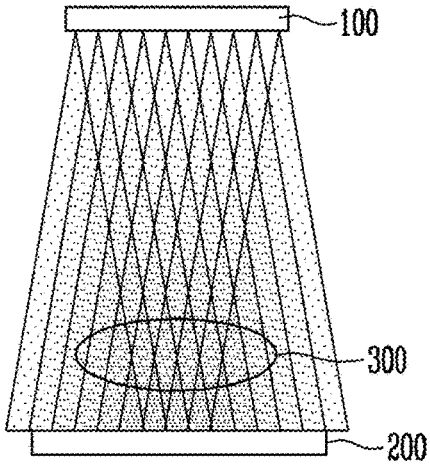

Referring to FIG. 7B, the X-ray source array 100 emits an X-ray with a wide radiation angle. In this case, it is possible to obtain a plurality of images from the X-rays emitted from the plurality of X-ray sources. Further, some of the images obtained from the X-rays emitted from the adjacent X-ray sources overlap, so that it is possible to configure tomography through the overlapping images.

Figure 7C:
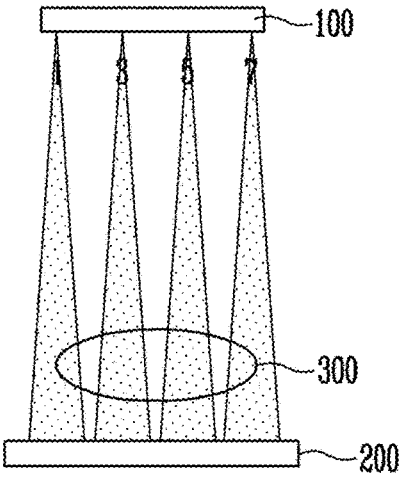
Figure 7D:
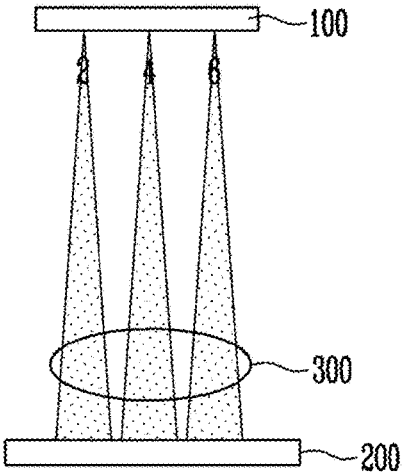

Referring to FIGS. 7C and 7D, the X-ray source included in the X-ray source array 100 is selectively driven. In this case, the X-ray source is selected so that the X-rays reaching the detector 200 do not overlap. For example, a first image is obtained from the X-ray sources arranged in odd numbers, and a second image is obtained from the X-ray sources arranged in even numbers. Here, the first image and the second image partially overlap, so that it is possible to generate a two-dimensional X-ray image by composing the overlapping images.

Figure 8:
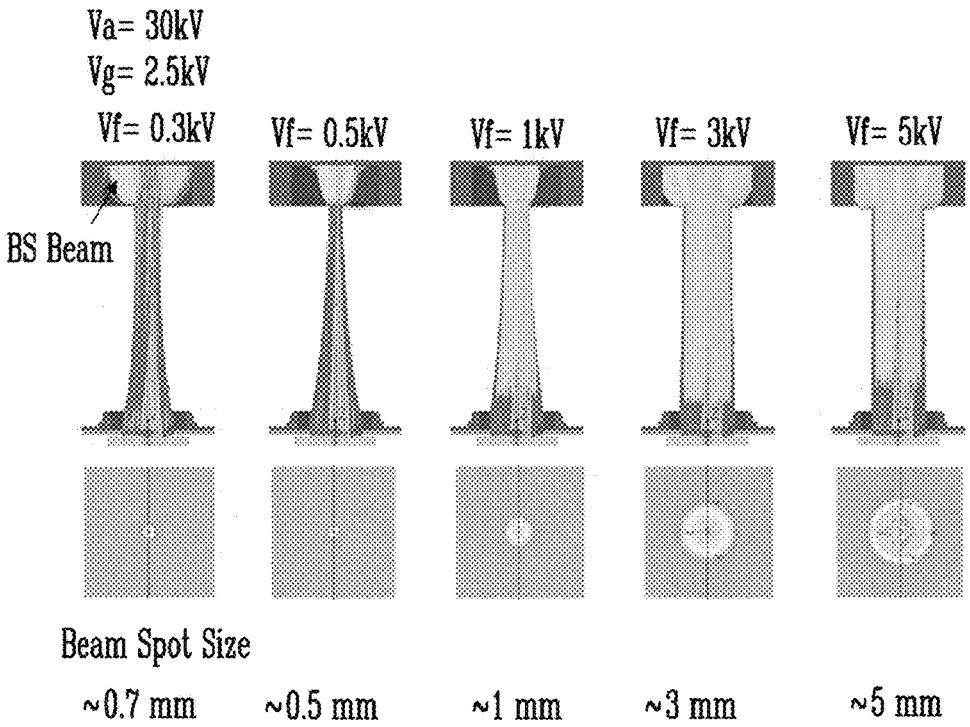
FIG. 8 is a graph representing a simulation result of an E-beam of the X-ray device according to the exemplary embodiment of the present disclosure.

FIG. 8 is a graph representing a simulation result of an E-beam of the X-ray device according to the exemplary embodiment of the present disclosure.

Referring to FIG. 8, it can be seen that when a focus voltage $V_f$ is changed to 0.3 kV, 0.5 kV, 1 kV, 3 kV, and 5 kV in a state where an anode voltage $V_a$ is fixed at 30 kV and a gate voltage $V_g$ is fixed at 2.5 kV, a diameter of an E-beam reaching the anode target is changed from about 0.7 mm to 5 mm. Based on this, it can be seen that it is possible to easily adjust a diameter of the E-beam by adjusting the focus voltage $V_f$.

The technical spirit of the present disclosure have been described according to the exemplary embodiment in detail, but the exemplary embodiment has described herein for purposes of illustration and does not limit the present disclosure. Further, those skilled in the art will appreciate that various exemplary embodiments may be made within the technical spirit of the present disclosure.

What is claimed is:

1. An X-ray source, comprising:

a cathode including a shielding channel through which an X-ray passes;

emitters formed on an upper surface of the cathode, and arranged around the shielding channel;

an anode positioned so as to face the cathode, and including an anode target in which an E-beam is focused; and a gate electrode positioned between the cathode and the anode, and including gate holes at positions corresponding to those of the emitters.

2. The X-ray source of claim 1, wherein the shielding channel passes through the cathode in a thickness direction of the cathode, and has an inlet and an outlet which have the same width.

3. The X-ray source of claim 1, wherein the shielding channel passes through the cathode in a thickness direction of the cathode, and has an inlet and an outlet, in which the inlet has a larger width than that of the outlet.

4. The X-ray source of claim 1, wherein a radiation angle of the X-ray emitted from the anode target is determined by adjusting a diameter of an E-beam which is focused in the anode target.

5. The X-ray source of claim 1, wherein a radiation angle θ of the X-ray emitted from the anode target and a diameter D of the X-ray, which passes through the shielding channel and reaches a detector, satisfy an equation below, $$d_1 \approx 0,\ d_3 \geq d_2$$

$$D_{min} = d_2\left(1 + \frac{L}{l1}\right)$$

$$\theta_{min} = 2\tan^{-1}\left(\frac{D_{min} - d_2}{2L}\right)$$

here, $d_1$ represents a diameter of the E-beam which is focused in the anode target, $d_2$ represents a diameter of an outlet of the shielding channel, $l_1$ represents a distance from the anode target to the outlet of the shielding channel, and L represents a distance from the outlet of the shielding channel to the detector.

6. The X-ray source of claim 1, wherein the X-ray, which passes through the shielding channel and reaches a detector, satisfies an equation below, $$d_{1max} = \frac{l_1}{l_2}(d_2 + d_3) - d_2$$

here, $d_{1max}$ represents a maximum diameter of an E-beam, which is focused in the anode target, $l_1$ represents a distance from the anode target to an outlet of the shielding channel, $l_2$ represents a distance of the shielding channel, $d_2$ represents a diameter of the outlet of the shielding channel, and $d_3$ represents a diameter of an inlet of the shielding channel.

7. The X-ray source of claim 6, wherein a radiation angle θ of the X-ray emitted from the anode target and a diameter D of the X-ray, which passes through the shielding channel and reaches a detector, satisfy an equation below, $$d_1 < d_{1max},\ d_3 \geq d_2$$

$$D = \frac{d_1 + d_2}{l_1}L + d_2$$

$$\theta = 2\tan^{-1}\left(\frac{D - d_2}{2L}\right)$$

here, $d_1$ represents a diameter of an E-beam which is focused in the anode target, $d_{1max}$ represents a maximum diameter of the E-beam, which is focused in the anode target, $d_2$ represents the diameter of the outlet of the shielding channel, $l_1$ represents the distance from the anode target to the outlet of the shielding channel, and L represents a distance from the outlet of the shielding channel to the detector.

8. The X-ray source of claim 6, wherein a radiation angle θ of the X-ray emitted from the anode target and a diameter D of the X-ray, which passes through the shielding channel and reaches a detector, satisfy an equation below, $$d_1 = d_{1max},\ d_3 \geq d_2$$

-continued $$D_{max} = \frac{d_2 + d_3}{l_2} L + d_2$$

$$\theta_{max} = 2\tan^{-1}\left(\frac{d_2 - d_3}{2l_2}\right)$$

here, $d_1$ represents a diameter of an E-beam which is focused in the anode target, $d_2$ represents the diameter of the outlet of the shielding channel, $d_3$ represents the diameter of the inlet of the shielding channel, $l_2$ represents the distance of the shielding channel, and L represents a distance from the outlet of the shielding channel to the detector.

9. The X-ray source of claim 1, wherein the cathode includes:

a first plate including a first shielding channel through which the X-ray passes; and a second shielding channel, through which the X-ray passing through the first shielding channel passes.

10. The X-ray source of claim 9, wherein the second shielding channel has a narrower width than that of the first shielding channel.

11. The X-ray source of claim 1, wherein a surface of the anode target has a concave shape.

12. The X-ray source of claim 1, wherein the emitter includes a first emitter, which is relatively adjacent to the shielding channel, and a second emitter, which is relatively spaced apart from the shielding channel, the opening includes a first gate hole corresponding to the first emitter and a second gate hole corresponding to the second emitter, center axes of the second emitter and the second gate hole correspond to each other, and the first emitter is positioned while being slant to the shielding channel.

13. The X-ray source of claim 1, further comprising:

a focusing electrode positioned between the gate electrode and the anode.

14. An X-ray device, comprising:

a plurality of X-ray sources, each of which includes a cathode including a shielding channel, through which an X-ray passes, emitters formed on an upper surface of the cathode and arranged around the shielding channel, an anode positioned so as to face the cathode and including an anode target in which an E-beam is focused, and a gate electrode positioned between the cathode and the anode, and including gate holes at positions corresponding to those of the emitters, wherein the plurality of X-ray sources is arranged in an array form.

15. The X-ray device of claim 14, wherein the plurality of X-ray sources are sealed, respectively.

16. The X-ray device of claim 14, wherein the cathode, the anode, and the gate electrode have a plate form, and the cathode includes a plurality of shielding channels.

17. The X-ray device of claim 16, wherein the cathodes included in the plurality of X-ray sources are electrically separated for each array, and are controlled in a unit of an array.

* * * * *